US011124976B2

(12) United States Patent
Prestes de Andrade

(10) Patent No.: US 11,124,976 B2
(45) Date of Patent: Sep. 21, 2021

(54) KIT FOR SPACING AND LEVELING OF TILES AND METHODS OF USE

(71) Applicant: Jefferson Prestes de Andrade, Curitiba (BR)

(72) Inventor: Jefferson Prestes de Andrade, Curitiba (BR)

( * ) Notice: Subject to any disclaimer, the term of this patent is extended or adjusted under 35 U.S.C. 154(b) by 0 days.

(21) Appl. No.: 17/048,371

(22) PCT Filed: Mar. 5, 2020

(86) PCT No.: PCT/BR2020/050070
§ 371 (c)(1),
(2) Date: Oct. 16, 2020

(87) PCT Pub. No.: WO2020/191470
PCT Pub. Date: Oct. 1, 2020

(65) Prior Publication Data

US 2021/0180339 A1 Jun. 17, 2021

(30) Foreign Application Priority Data

Mar. 27, 2019 (BR) ..... 10 2019 006025 5

(51) Int. Cl.
*E04F 21/22* (2006.01)
*E04F 21/00* (2006.01)

(52) U.S. Cl.
CPC ..... *E04F 21/22* (2013.01); *E04F 21/0092* (2013.01)

(58) Field of Classification Search
CPC ..... E04F 21/0092; E04F 13/0892; E04F 15/02005; E04F 21/20
See application file for complete search history.

(56) References Cited

U.S. PATENT DOCUMENTS

| | | | | |
|---|---|---|---|---|
| D630,077 | S * | 1/2011 | Kufner | D8/105 |
| 7,954,300 | B1 * | 6/2011 | Kufner | E04F 21/22 52/749.11 |
| 7,992,354 | B2 | 8/2011 | Doda, Jr. | |
| 8,079,199 | B1 * | 12/2011 | Kufner | E04F 13/0892 52/749.11 |
| 8,671,628 | B2 | 3/2014 | Sighinolfi | |
| 8,800,246 | B2 | 8/2014 | Gorton | |
| 9,534,403 | B2 * | 1/2017 | Biec | E04F 21/0092 |
| 9,970,203 | B1 * | 5/2018 | Abidov | E04F 21/0092 |
| 2010/0263304 | A1 * | 10/2010 | Torrents I Comas | E04F 21/0092 52/126.5 |

(Continued)

FOREIGN PATENT DOCUMENTS

| | | | |
|---|---|---|---|
| BR | PI0400097 | A | 9/2005 |
| BR | 102014021953 | A2 | 4/2015 |

(Continued)

*Primary Examiner* — Babajide A Demuren
(74) *Attorney, Agent, or Firm* — Berenato & White, LLC

(57) ABSTRACT

A kit for spacing and leveling tiles such as marble, granite and ceramics, applied to the edges of the parts for leveling and spacing of tiles, through an innovative construction device with a leveling base, spacer rod, crosshead and wedge-type leveler that has as the purpose of keeping the spacing and leveling of the tile pieces, correcting the differences of level, bringing advantages of greater flexibility of use without loss of application quality, agility in the laying of cladding panels, practicality and multifunctionality.

6 Claims, 4 Drawing Sheets

(56) References Cited

U.S. PATENT DOCUMENTS

| | | | | |
|---|---|---|---|---|
| 2012/0144773 | A1* | 6/2012 | Mauro | E04F 15/02022 52/747.11 |
| 2013/0055675 | A1* | 3/2013 | Sighinolfi | E04F 15/02022 52/749.11 |
| 2014/0033640 | A1* | 2/2014 | Gorton | E04F 21/0092 52/747.11 |
| 2015/0308130 | A1* | 10/2015 | Biec | E04F 21/0092 52/749.11 |
| 2016/0222679 | A1 | 8/2016 | Bunch et al. | |
| 2018/0100315 | A1* | 4/2018 | Volponi | E04F 21/0092 |
| 2018/0291640 | A1 | 10/2018 | Sighinolfi | |

FOREIGN PATENT DOCUMENTS

| | | | |
|---|---|---|---|
| BR | 102012020884 | A2 | 8/2015 |
| BR | 202013017227 | U2 | 11/2015 |
| BR | 102014010232 | A2 | 2/2016 |
| BR | 202014012502 | U2 | 6/2016 |
| GB | 2538545 | A | 11/2016 |

* cited by examiner

KIT FOR SPACING AND LEVELING OF TILES AND METHODS OF USE

CROSS-REFERENCE TO RELATED APPLICATIONS AND CLAIM TO PRIORITY

This application is a national stage application of International Application No. PCT/BR2020/050070 filed Mar. 5, 2020, which claims priority to Brazilian Application No. 10 2019 006025 5 filed Mar. 27, 2019, the disclosures of which are incorporated herein by reference and to which priority is claimed.

FIELD OF THE INVENTION

This invention relates to a kit for spacing and leveling tiles such as marble, granite and ceramics, which is applied to the edges of the tiles for the leveling and/or spacing of the tiles, through a device with an innovative design that serves the purpose of spacing and leveling the tiles, correcting the unevenness. The invention has the advantages of greater flexibility of use without loss of application quality, agility in the laying of cladding panels, practicality and multifunctionality.

BACKGROUND OF THE INVENTION

The method of civil construction, more specifically concerning the application of tiles on floors and walls, is currently the following:

- Leveling by ruler and level by adjusting the thickness of the mortar;
- Straight leveling the base for ceramics that have uniform thicknesses (not applicable for marble and granite that have variable thicknesses); Applying cross-shaped spacers (not levelers); and
- Adding circular-shaped clip levelers positioned underneath the pieces.

A patent search identified the following related art:

Brazilian patent BR 10 2014 021953 6 A2 entitled "Leveling Device of Floors and Coatings" discloses two pieces, with a base applied on the floor with a thread, and a spacer that is arranged under the floor, wherein the spacing between the floors allows a perpendicular flange to be positioned to receive the base.

Brazilian patent BR 20 2013 017227 3 U2 entitled "Shoe Leveler for Laying Coating Plates," is a utility model that discloses a device intended to assist the construction professional in laying coating plates with mortar. The device consists of a shoe with a wedge-shaped lateral profile. Its upper face is flat and horizontal, while its lower face is inclined and supplied with longitudinal feet spaced parallel to each other. The device is intended to be positioned between the coating plates, at the meeting point of their vertices, so that, at the time of laying the coating plates, a shoe is arranged at each meeting point of the vertices of the plates, thus causing each plate to be supported on its four vertices, each vertex on a distinct shoe. As a result, the thickness of the mortar is limited by the height of the shoe. Further, if the counter-floor is uneven, a second shoe is inserted under the first shoe, however with the face flat down, and the bottom shoe is slid horizontally.

Brazilian patent PI 0400097-8 entitled "Ceramic Coating and Floor Leveler" is a patent of invention relating to leveling and adjusting ceramics and floors comprised of a tube with a cavity to store the accessories that accompanies the device on one side and a battery on the other side. The patent describes a Part 2 that consists of a side that stocks the accessories being capped by Part 4, and the other side receives a nozzle as a cover. Part 1 functions to cap the battery compartment and is also the main operating body of the device, which has a laser adjustment lens fixed on the nozzle. Part 13, which includes Part 1 and is also embedded inside the accessories 16, is an energy transmission board that has embedded in its surface the laser transmitter that is directed toward a lens. Part 15 is a switch and Part 14 is a spring welded on the plate. Parts 16, 15 and 14 form a set glued inside the tube. Part 12 is made of iron to transmit negative energy to the plate and is embedded inside the nozzle. The nozzle also receives the switch lengthening formed by Parts 5 and 11. Part 6 carries negative battery energy to the tube and also serves to give greater resistance to the fitting of Parts 1 and 2. Parts 7, 8, 9 and 10 are the accessories that come with the device. If the appliance is not in use, it can be attached to a pocket with a cable (Part 3).

U.S. Pat. No. 7,992,354 entitled "Device for leveling and aligning tiles and methods for leveling and aligning tiles" discloses a tile leveling device. The device includes a main member, a first section extending transversely from the main member for receiving a first tile and a second section extending transversely from the main member in a direction opposite the first section for receiving a second tile. A member is provided for penetrating the main member and exerting a force on the tiles for leveling them relative to each other. A method for leveling tiles is also described.

U.S. Pat. No. 8,671,628 entitled "Spacing/leveling device for laying slab products for surface cladding" discloses an intake manifold of comburent air for an internal combustion engine provided with a recirculating conduit of exhaust gases. The intake manifold includes a first inlet mouth of the comburent air, a second inlet mouth in communication with the recirculating conduit of the exhaust gases, and a plurality of outlet mouths, having a wall positioned in front of each of the outlet mouths and configured for dividing the internal volume of the intake manifold into two chambers, the first chamber being placed in communication with the first inlet mouth and the second inlet mouth and the second chamber being placed in communication with the outlet mouths, the wall defining an opening adapted for placing the first chamber and the second chamber in communication.

U.S. patent US 2018291640 entitled "Spatial Screen Leveling Device" discloses a device with a base having a lower surface and an opposite upper surface, in which the upper surface comprises two opposite lateral pores in relation to a central part and each defines a flat surface disposed a second distance from the lower surface, in which the second distance is less than a first distance. Additionally, a spacer bridge that defines with the base a passing opening adapted to be crossed by a pressure wedge in which each side part has a longitudinal axis parallel to the direction of crossing the pressure wedge and extends the entire length of the base along that direction of crossing, and the second distance is between 20% and 90% of the first distance.

U.S. patent US2016222679 entitled "Device for Leveling and Aligning Tiles and Method for Leveling and Aligning Tiles" discloses a device for leveling and aligning tiles and a method for leveling and aligning tiles. In one embodiment, the leveling device includes a body and two spaced and parallel strip members extending transversely from the body. Each of the spaced and parallel strip members extend to the front and rear of the body. Two opposing lateral open windows are formed in the body. A breakaway section is defined along the body. A wedge device is provided for penetrating one or more of the two opposing lateral open windows and exerting a force on the tiles for leveling them relative to each other.

The currently existing levelers and spacers have disadvantages, drawbacks and limitations for failing to incorporate in a kit a device with two different spacers and a leveler, all removable and a wedge with the dual purpose of removing the spacers and locking together, achieving with a single device the function of spacer and leveler.

SUMMARY OF THE INVENTION

The object of this invention was developed to overcome the disadvantages, limitations and drawbacks of the current levelers and spacers, by including a kit equipped with a leveling device and spacer of unprecedented and optimized shape composed of a single multifunctional piece, and wedge of new format and optimized with a special tool that detach the components to obtaining two separate parts, which are a leveler spacer and a cross-level spacer, providing greater flexibility of use without loss of application quality, agility in laying coating plates, practicality and multifunctionality.

The following technical problems associated with the current products have been addressed by this invention:

A) The current products are manufactured separately from the cross-leveler spacer and the leveler spacer. This invention solves this problem by providing a single device that allows on one side the use of cross-type spacer and on the other side the use as a leveler spacer; and B) The current spacer rods, called reeds, are manufactured separately from the other spacers. This invention solves this problem by providing a single device that contains a leveling spacer with cross-spacer and a vane spacer.

BRIEF DESCRIPTION OF THE DRAWINGS

For better understanding of this invention reference is made to the following attached figures.

DETAILED DESCRIPTION OF THE PREFERRED EMBODIMENT(S)

Figure 1:
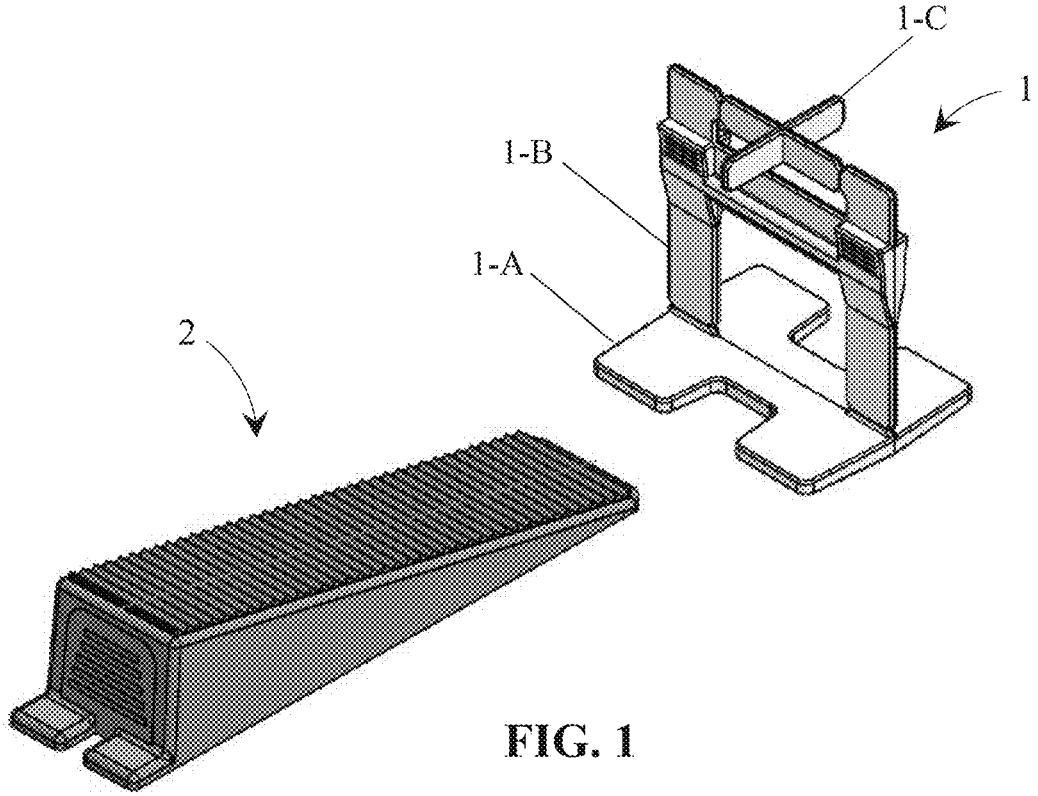
FIG. 1 is a perspective view of the leveler kit and spacer for tiles of this invention.
Figure 2:
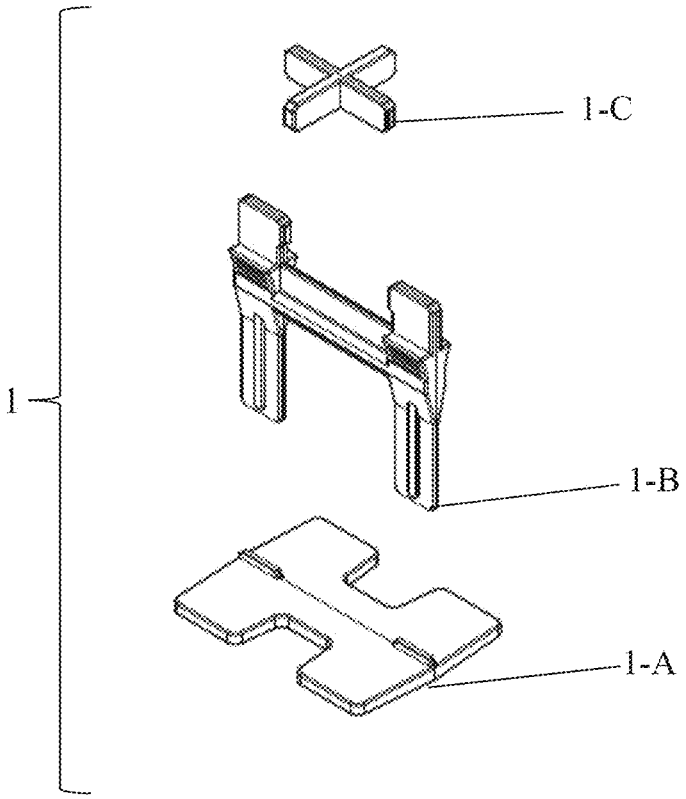
FIG. 2 is an exploded perspective view of the invention showing the leveling base, spacer rod and cross leveler.
Figure 3:
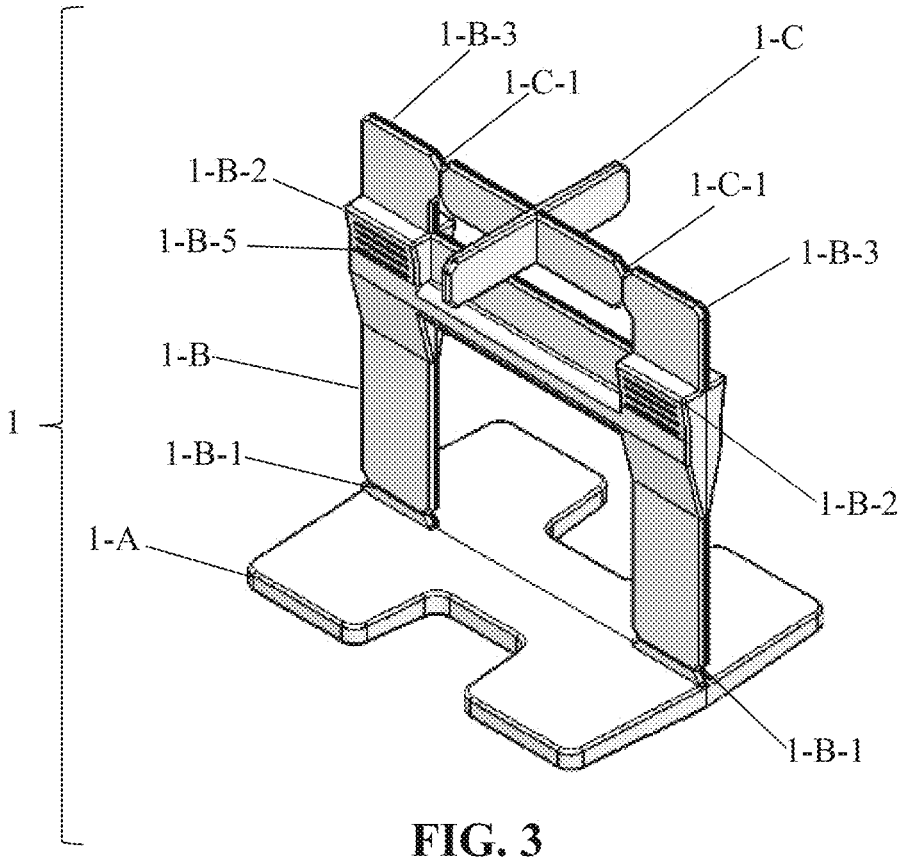
FIG. 3 is a perspective view of the leveler and spacer device for tiles of this invention.
Figure 4:
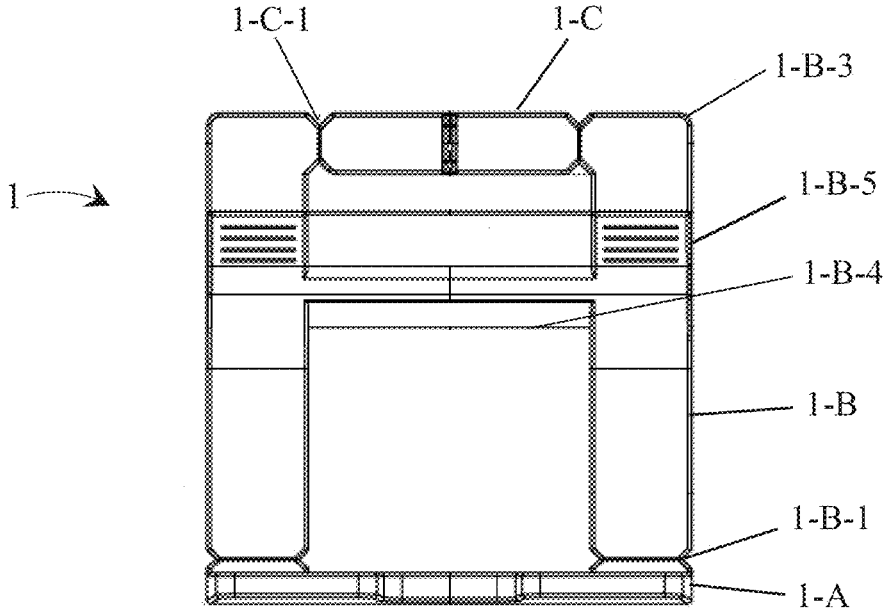
FIG. 4 is a front view of the leveling device and spacer for tiles of this invention.
Figure 5:
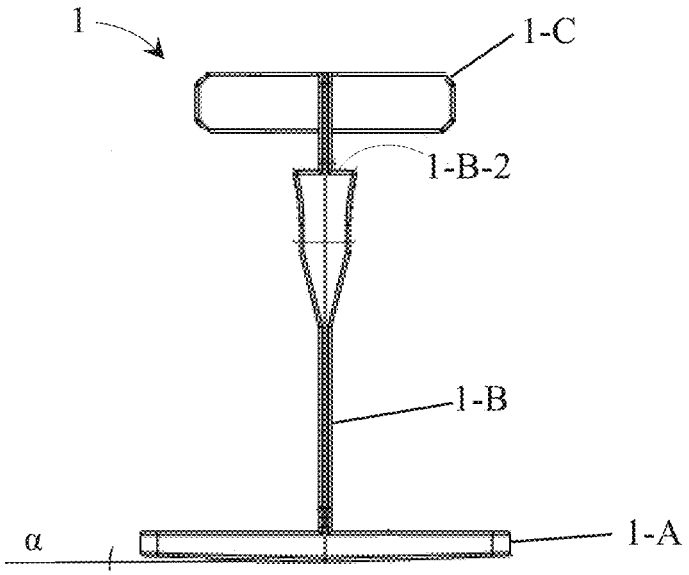
FIG. 5 is a left side view of the leveling device and spacer for tiles of the invention detailing angle (α).
Figure 6:
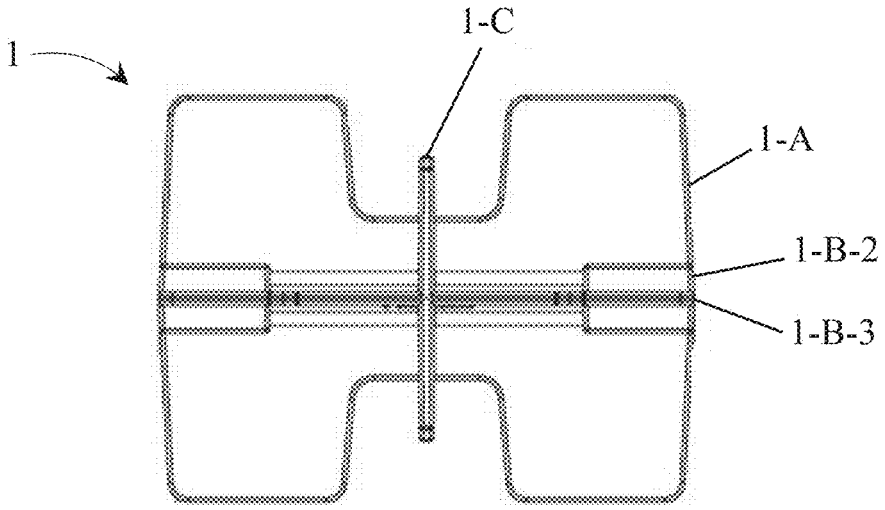
FIG. 6 is a top view of the leveling device and spacer for tiles of this invention.
Figure 7:
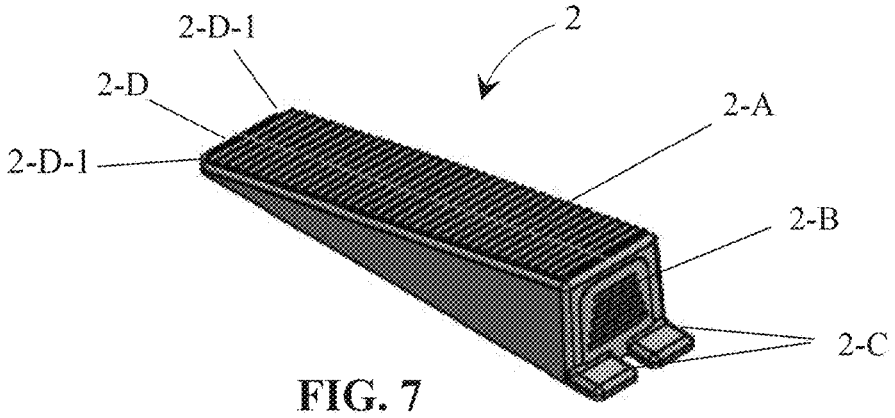
FIG. 7 is a perspective view of the wedge-type leveling device for tiles of this invention.
Figure 8:
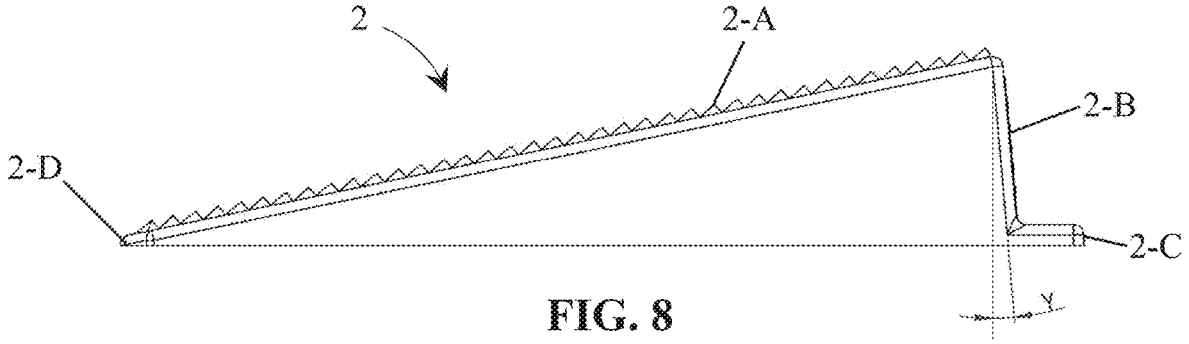
FIG. 8 is a right side view of the wedge-type leveling device for tiles of the invention detailing angle (γ).
Figure 9:
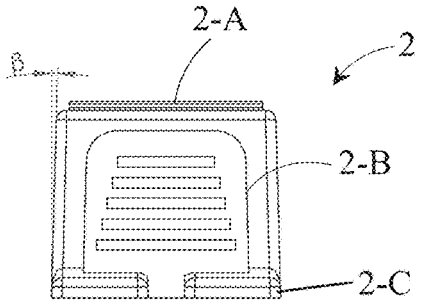
FIG. 9 is a rear view of the wedge leveling device for tiles of the invention detailing angle (β).

When the leveling and spacing device (1) is integral, it is used as a leveler spacer (1-A) and (1-B) and, when rotating the position of the device 180°, it is used as a cross-raiser or cross-stitcher.

After use as a leveler spacer (1-A) and (1-B), the top is detached and, when separated from the leveling base (1-A), forms three more spacer functions:

a) A spacer called a vane spacer rod (1-B). Turning the device 180° from the original position and detaching the cross-leveler (1-C), the rod (1-B-3) is used in the spacing of tiles. When using the device in this configuration, the boss (1-B-2) limits the depth of the reed; and b) The detached crosser (1-C) can be used as a spacer independently of the spacer rod (1-B) at the vertices of tiles; or c) A spacer called a cross-leveler (1-B) and (1-C). By turning the spacer 180° from the original position, the cross-leveler (1-C) is used in the spacing of tiles by aligning at the vertices of the tiles. When using the device in this configuration, the boss (1-B-2) limits the depth of the cross.

Therefore, the device is divided into a leveling base (1-A) and cross-stitcher spacer (1-B) and (1-C) or vane spacer rod (1-B) and cross-leveler (1-C). The spacer rod (1-B) has a vertical "H" shape with a shoulder (1-B-2) with a stop function that guarantees the depth limit of the spacer and cross-sectional spacer (1-B) and (1-C), and with surface grooves (1-B-5) that ensures adherence to the application of the spacer rod. The wedge leveler (2), besides having the locking function, is used as a lever for removing the cross (1-C) to be used separately. The wedge leveler (2) has a pyramidal trunk shape that allows greater stability when using the wedge leveler (2) and grooves (2-B) on the rear surface that have a non-slip function to improve adhesion during application.

The angle (α) on the leveling base (1-A) ranges from 1 to 3 degrees, preferably 2 degrees, and facilitates the introduction of mortar causing it to accumulate at the bottom of the base by pushing it up and approaching the bottom of the tile.

The angle (β) on the wedge leveler (2) varies from 1 to 2 degrees, preferably 1.5 degrees and allows greater stability when using the leveler (2).

The angle (γ) on the wedge leveler (2) varies from 2 to 8 degrees, preferably 5 degrees and allows a greater contact base when using the leveler (2).

The tip (2-D) of the wedge leveler (2) has two chamfers (2-D-1) that facilitate input at the beginning of the rack (2-A).

According to the figures, the kit for spacing and leveling of tiles consists of a leveling device and spacer (1) in a single set equipped with a leveling base (1-A) in a rectangular prismatic shape with two cuts on the sides forming a horizontal "H" and with a triangular base with an aperture (a) ranging from 1 to 3 degrees; vane spacer (1-B) with a vertical "H" shape with a predominantly rectangular section with two detachable cutouts (1-B-1) and attached to leveling base (1-A), with two pyramidal-trunk shaped shoulders (1-B-2) at the upper intermediate part with two "L" shaped reeds (1-B-3) attached at the crossbar (1-C), with latch (1-B-4) for the wedge leveler (2) with an angle compatible with the rack (2-A) and rectangular groove lines (1-B-5) positioned horizontally on the surface of the shoulders (1-B-2); and cross-border (1-C) of rectangular-prismatic shape in the form of a cross with cutouts (1-C-1) detachable and attached at the spacer rod (1-B); and pyramidal-trunk wedge leveler (2) with a rack top (2-A) with an angle compatible with the leveler latch (1-B-4) and with a trapezoidal-shaped rear with an angle (β) ranging from 1 to 2 degrees, inclined with angle (γ) ranging from 2 to 8 degrees, with rectangular shaped lines of shoulders (2-B) positioned horizontally and equipped with tool (2-C) consisting of two chamfered and tip spaced rods (2-D) with two chamfers (2-D-1) at the beginning of the rack (2-A).

Additionally, the kit may have a variety of thicknesses and sizes as long as it maintains its proportions.

The application or use should be done in conjunction with leveler (2-C), as follows:

In the case of the use of the leveling base (1-A) and spacer rod (1-B):

I. After spreading the mortar, insert the spacer leveler (1) under the floor along the sides using two leveling spacers (1) for each side of the spacing coating piece.

II. Hit the floor with a white rubber hammer and insert the wedge leveler (2) until the initial locking;

III. Apply the pressure required to insert to the leveler until optimal leveling is achieved; and IV. Once the mortar is dry, remove the vanes from the spacer levelers with the pliers.

In the case of the use of the spacer (1-C) of the cross-type:

A) The spacer clip (1-C) of the vane (1-B) stands out by using the rods (2-B) of the wedge leveler (2) with leverage; and B) Once detached, the spacer (1-C) is positioned between the pieces to maintain the desired spacing.

It is also possible to use the cross-leveler (1-B+1-C) with the spacer rods (1-B):

C) Detach the spacer rod (1-B) of the leveling base (1-A) with pliers;

D) Turn the spacer rod (1-B) 180° from the original position and store the crosser (1-C); and E) Position the cross-leveler (1-C) at the vertices of the tiles to maintain the desired spacing. The shoulder (1-B-2) ensures the depth limit of the cross-edge application (1-B).

In the case of the use of the vane spacer rod (1-B):

i) Detach the spacer rod (1-B) of the leveling base (1-A) with pliers;

ii) Turn the spacer rod (1-B) 180° from the original position and detach the cross-leveler (1-C) with pliers or through the use of the wedge leveler (2-B) from the rods (2) with a leverage; and iii) Position the spacer rod (1-B) on the sides of the tiles. The shoulder (1-B-2) ensures the depth limit of the application of the reed (1-B).

The invention claimed is:

1. A kit for spacing and leveling tiles, comprising a leveling and spacing device with a leveling base in a rectangular-prismatic shape with two cuts on the sides forming a horizontal "H" and with a triangular base, wherein the leveling and spacing device is integral with the leveling base and the triangular base comprises opening ($\alpha$) varying from 1 to 3 degrees; the kit further comprising a vertical "H" vane spacer rod with a predominantly rectangular section with two detachable cutouts and a attached leveling base, with two shoulders with a pyramidal-trunk shape in the upper intermediate part with two "L" shaped reeds attached to a crosshead, with a lock for a wedge-type leveler with an angle compatible with a rack and lines of grooves of rectangular shape positioned horizontally on the surface of the shoulders; and a cross with a rectangular prismatic shape in the shape of a cross with detachable cutouts and attached to the spacer rod; and a wedge-type leveler with a pyramid-shaped trunk with an upper part equipped with a rack with an angle compatible with the leveler lock and with a trapezoidal-shaped rear with an angle ($\beta$) varying from 1 to 2 degrees, inclined at an angle ($\gamma$) varying from 2 to 8 degrees, with lines of rectangular projections positioned horizontally and equipped with a tool consisting of two spaced spans chamfered shape and tip with two chamfers facilitating entry at the beginning of the rack.

2. A kit for spacing and leveling tiles, according to claim 1, wherein the angle ($\alpha$) in the leveling base is 2 degrees.

3. A kit for spacing and leveling tiles, according to claim 1, wherein the angle ($\beta$) is 1.5 degrees.

4. A kit for spacing and leveling tiles, according to claim 1, wherein the angle ($\gamma$) is 5 degrees.

5. A kit for spacing and leveling tiles, according to claim 1, wherein the kit integrally comprises on one side a cross spacer and on the other side a leveling spacer.

6. A kit for spacing and leveling tiles, according to claim 1, wherein the kit comprises a single spacer rod, and a crosshead or a crosshead spacer.

* * * * *